US005883599A

United States Patent [19]

Hall

[11] Patent Number: 5,883,599

[45] Date of Patent: Mar. 16, 1999

[54] ANTENNA SYSTEM FOR A MOTOR VEHICLE

[75] Inventor: Scott Wayne Hall, Ypsilanti, Mich.

[73] Assignee: Ford Motor Company, Dearborn, Mich.

[21] Appl. No.: 784,222

[22] Filed: Jan. 16, 1997

[51] Int. Cl.[6] ..... H01Q 1/32

[52] U.S. Cl. ..... 343/713; 343/704

[58] Field of Search ..... 343/704, 713, 343/741; H01Q 1/32

[56] References Cited

U.S. PATENT DOCUMENTS

| | | | |
|---|---|---|---|
| 3,766,563 | 10/1973 | Sauer et al. | 343/713 |
| 3,845,489 | 10/1974 | Sauer et al. | 343/713 |
| 4,090,202 | 5/1978 | Comastri et al. | 343/713 |
| 4,749,998 | 6/1988 | Yotsuya | 343/713 |
| 4,821,042 | 4/1989 | Ohe et al. | 343/713 |
| 4,823,140 | 4/1989 | Shibata et al. | 343/713 |
| 4,823,142 | 4/1989 | Ohe et al. | 343/713 |
| 5,017,933 | 5/1991 | Sakurai et al. | 343/704 |
| 5,177,494 | 1/1993 | Dorrie et al. | 343/713 |
| 5,185,612 | 2/1993 | Tsukada et al. | 343/713 |
| 5,313,217 | 5/1994 | Kakizawa | 343/713 |
| 5,457,467 | 10/1995 | Schenkyr et al. | 343/713 |
| 5,581,264 | 12/1996 | Tabata et al. | 343/713 |

FOREIGN PATENT DOCUMENTS

| | | | |
|---|---|---|---|
| 0367555 | 5/1990 | European Pat. Off. | 343/713 |
| 08181519 | 7/1996 | Japan . | |
| 08265028 | 10/1996 | Japan . | |

*Primary Examiner*—Don Wong
*Assistant Examiner*—Tan Ho
*Attorney, Agent, or Firm*—Donald A. Wilkinson

[57] ABSTRACT

A concealed antenna system (16) for a motor vehicle (10) including a first antenna element (18) mounted on a first window (20), or panel, of the vehicle and at least a second antenna element (30) mounted on a second window (19), or panel, of the vehicle. The first antenna element (18) includes a conductive line (22) and a conductive loop (26) connected to one another. The first and second antenna elements are connected to one another in series by a wire (32) between the loop (26) on the first antenna element (18) and a conductive portion of the second antenna element (30).

3 Claims, 2 Drawing Sheets

ANTENNA SYSTEM FOR A MOTOR VEHICLE

FIELD OF THE INVENTION

The present invention relates to antenna systems used on motor vehicles and more particularly to antenna systems in which concealed antennas are employed.

BACKGROUND OF THE INVENTION

Conventional fixed mast antennas mounted to and extending from vehicle bodies have generally been known to provide adequate gain for receiving radio signals. However, these antennas have drawbacks in that they are generally unsightly and also are vulnerable to bending and breakage. Concealed antennas, on the other hand, do not have the drawbacks associated with the conventional antennas in that typically they are flush mounted directly to a glass panel or an isolated section of sheet metal in the vehicle.

Nonetheless, concealed antennas do generally encounter a problem in that they are generally configured small in order to fit onto a particular window or body panel. This can be particularly true for some vehicles in that there may only be a very few small panels, such as windows or isolated body panels, available given the shape of the particular vehicle. Thus, these surfaces may be small relative to the wavelengths of the signals one wishes to receive. For example, signals in the AM frequency band. For these antennas, then, a concern arises with having good reception in the AM frequency band because of a lack of low frequency gain due to the small size of the antenna. To account for this, the systems generally require the use of an AM amplifier module to get sufficient gain to overcome cable and mismatch losses and still have an adequate signal.

While some have attempted to overcome this concern by mounting concealed antennas on multiple surfaces of the vehicle, they are generally more complex than desirable or require other amplification, filtering or switching components to provide enough gain for an adequate signal in the frequency ranges desired.

Thus, a simple, concealed antenna system is desired that will provide adequate gain for both high and low frequencies, with the flexibility to configure the system for various vehicle designs.

SUMMARY OF THE INVENTION

In its embodiments, the present invention contemplates an antenna system for a motor vehicle. The antenna system includes a first and a second panel, with the panels being electrically isolated from the vehicle. A first antenna element is mounted on the first panel and includes a first conductor shaped as a generally vertical line and a second conductor generally shaped as a loop, with a first node connecting the first conductor and the second conductor, and with a second node on the second conductor, spaced from the first node. A second antenna element is mounted on the second panel and includes a third conductor having a third node. Also, the antenna system includes a conductive member extending between the second node on the first antenna element and the third node on the second antenna element such that the first and the second antenna elements are connected in series.

Accordingly, an object of the present invention is to provide antenna elements concealed in the windows or isolated panels of a vehicle in which the overall gain of the antenna system is increased by coupling the multiple antenna elements in series such that good radio frequency reception is possible for a broad range of frequencies.

An advantage of the present invention is that it provides multiple aperture coupling of antennas for increased antenna gain at low radio frequencies while not interfering with gain at higher frequencies, without the need for a low frequency amplifier.

an additional advantage of the present invention is that the multiple antenna elements can be coupled together without the need for components that isolate the higher radio frequencies between antenna elements, thus improving lower radio frequency reception without degrading higher radio frequency reception.

DETAILED DESCRIPTION OF THE PREFERRED EMBODIMENTS

Figure 1:
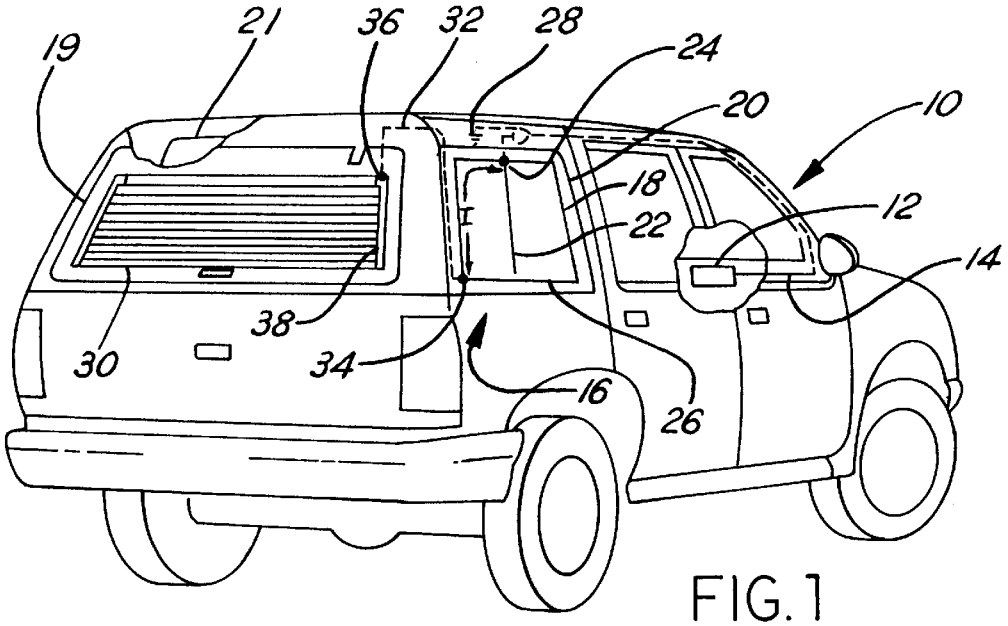
FIG. 1 is a schematic perspective view of a vehicle with the antenna system of the present invention.
Figure 2:
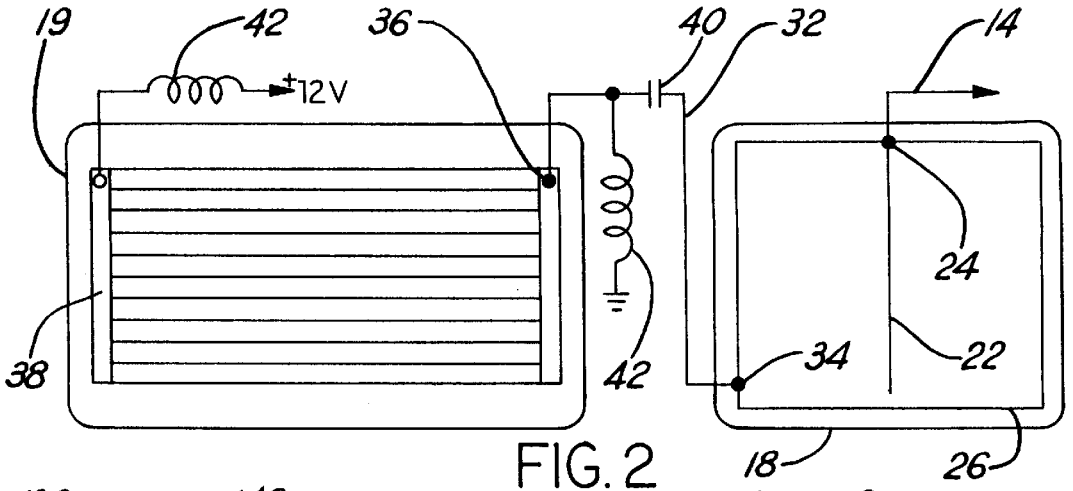
FIG. 2 is a schematic view of two of the vehicle windows of FIG. 1.

A first embodiment of the present invention is illustrated in FIGS. 1 and 2. A vehicle 10 includes a radio frequency (RF) reception device 12, such as a conventional AM/FM radio mounted therein. Connected to an antenna input for this device 12 is a coaxial cable 14, which extends, preferably concealed, within the body of the vehicle 10 back to a multiple aperture concealed antenna system 16. The vehicle includes a rear window 19, a right side rear window 20 and a left side rear window 21 on which the antenna system 16 can be mounted.

For this first embodiment, the antenna system 16 includes a first antenna element 18 mounted on the right side rear window 20. The first antenna element 18 is affixed to the glass 20 by known techniques, which will not be discussed further herein. The first antenna element 18 includes a single, generally vertical conductive line 22 connected at a node 24, at about the top center of the window 20, to a conductive loop 26 that extends around the periphery of the window 20 just inside of the edge. The coaxial cable 14 connects to the node 24 and includes a ground 28 at this location.

This first antenna element 18 will act as the primary antenna for reception of RF signals, with the single conductive line 22 for the higher RF reception (FM band). On the other hand, the loop 26 is a high impedance at frequencies in the FM band and increases the effective receive aperture for frequencies in the AM band. The FM performance of the first antenna element 18 has generally good omnidirectional FM gain patterns but the AM gain on the side window 20 alone is generally inadequate and thus needs improvement.

By coupling a second antenna element 30, with its own effective receive aperture, to the first antenna element 18, the AM gain is improved. For this embodiment, a wire 32 is connected between a second node 34 on the loop 26 of the first antenna element 18 and a node 36 on an otherwise conventional defroster grid 38, mounted on the rear window 19. The wire 32 can also be a coaxial cable if so desired, but not necessarily since an advantage of the present invention lies in the fact that just a wire can be used, which is much simpler to route within the vehicle 10 than a coaxial cable. The defroster grid 38, connected in series as described below, will now act as a secondary antenna element for AM reception, coupled to the first (primary) antenna element 18.

The second node 34, that acts to couple the two elements together, is at some distance I around the loop from the antenna feed point location (i.e., the first node 24). For this system, I is determined so that the wire 32 attaches to a high impedance point on the first antenna element 18, thereby having a minimal effect on the FM gain performance of the single vertical line 22. Generally, the distance I between the two nodes is determined to be about a quarter of a wavelength or less at FM frequencies, (e.g., about 76–108 MHz). This quarter wavelength is dependent upon antenna design and slot characteristics between antenna and body sheet metal. This distance is also dependent on how the antenna is shaped, and so may be different for antennas having a different shape than the first antenna element 18. In this way, inductors are not required in order to isolate the FM frequencies from the second antenna element 30.

The wire 32 is connected to the node 36 on the defroster grid 38 via a capacitor 40, to isolate the first antenna 18 from the current used to power the defroster grid 38. A pair of inductors 42 are connected on either side of the grid 38, one before ground and the other to the lead connected to a conventional power source, not shown, for the defroster grid 38, in order to effectively isolate the defroster grid 38 from ground and from the power source to provide better gain and electromagnetic interference (EMI) immunity.

Figure 3:
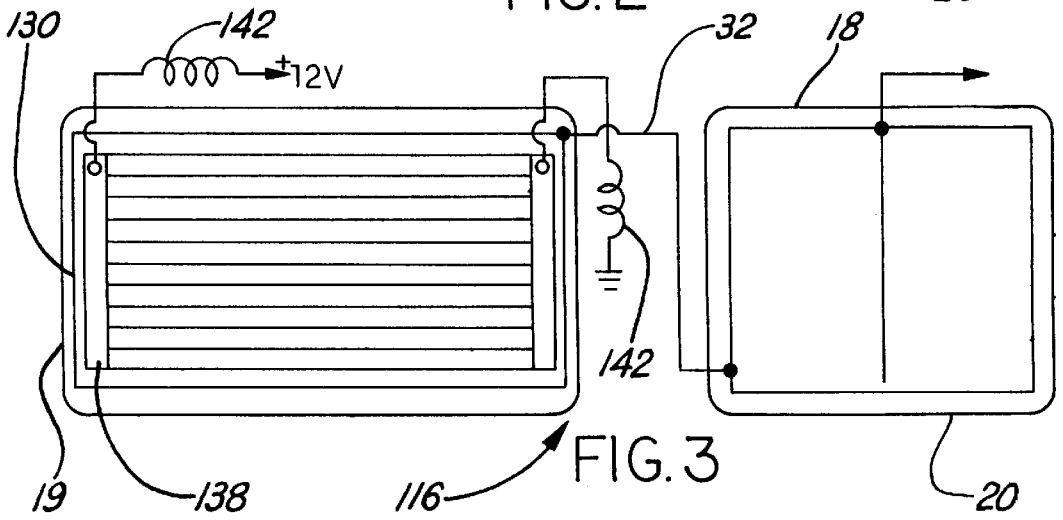
FIG. 3 is a schematic view similar to FIG. 2, illustrating a second embodiment of the present invention.

A second embodiment is illustrated in FIG. 3. In this embodiment, similar elements are similarly designated with the first embodiment, while changed elements are designated with 100 series numbers. The first antenna element 18 in the right rear side window 20 is the same, while the second antenna element 130 is no longer coupled to the rear defroster grid 138. The second antenna element 130 is formed by a conductive loop traced on the rear window 19 around the defroster grid 138. This better isolates the antenna assembly 116 from the defroster grid 138, but requires the additional trace on the rear window 19. The defroster grid 138 may still be coupled to the inductors 142 to provide better gain and EMI immunity, but are not necessary for this embodiment.

Figure 4:
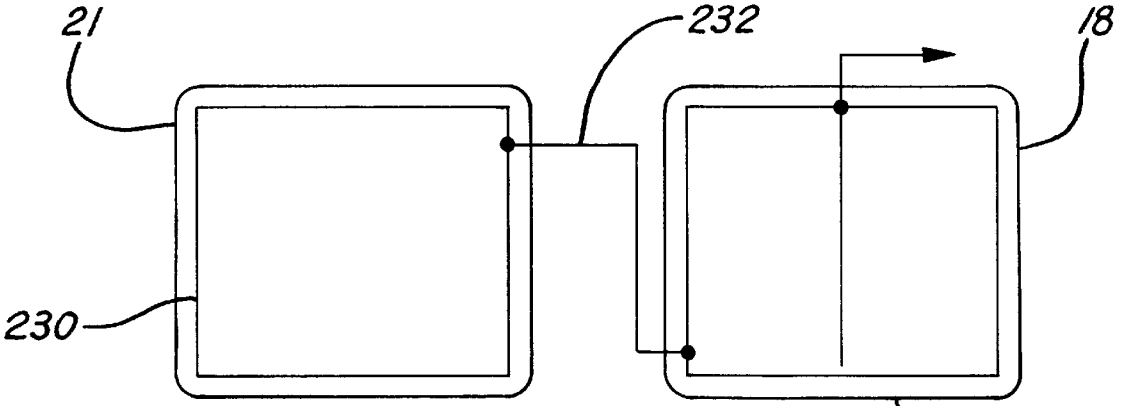
FIG. 4 is a schematic view similar to FIG. 2, illustrating a third embodiment of the present invention.

A third embodiment of the present invention is illustrated in FIG. 4. In this embodiment, similar elements are similarly designated with the first embodiment, while changed elements are designated with 200 series numbers. In this embodiment, the left side rear window 21 has a conductive trace of a loop printed on it to act as the second antenna element 230. The wire 232 now extends across the vehicle to couple the second antenna element 230 in series to the first antenna element 18. The point at which the wire 232 connects to the second antenna element 230 is generally chosen to be the most convenient assembly location. This second antenna element 230 performs the same function as the second antenna elements in the first and second embodiments, but may be more conveniently located for a particular vehicle design. A single loop is shown on the left side rear window 21, but, if desired, additional horizontal or vertical lines can be added to further improve the gain of the antenna.

Figure 5:
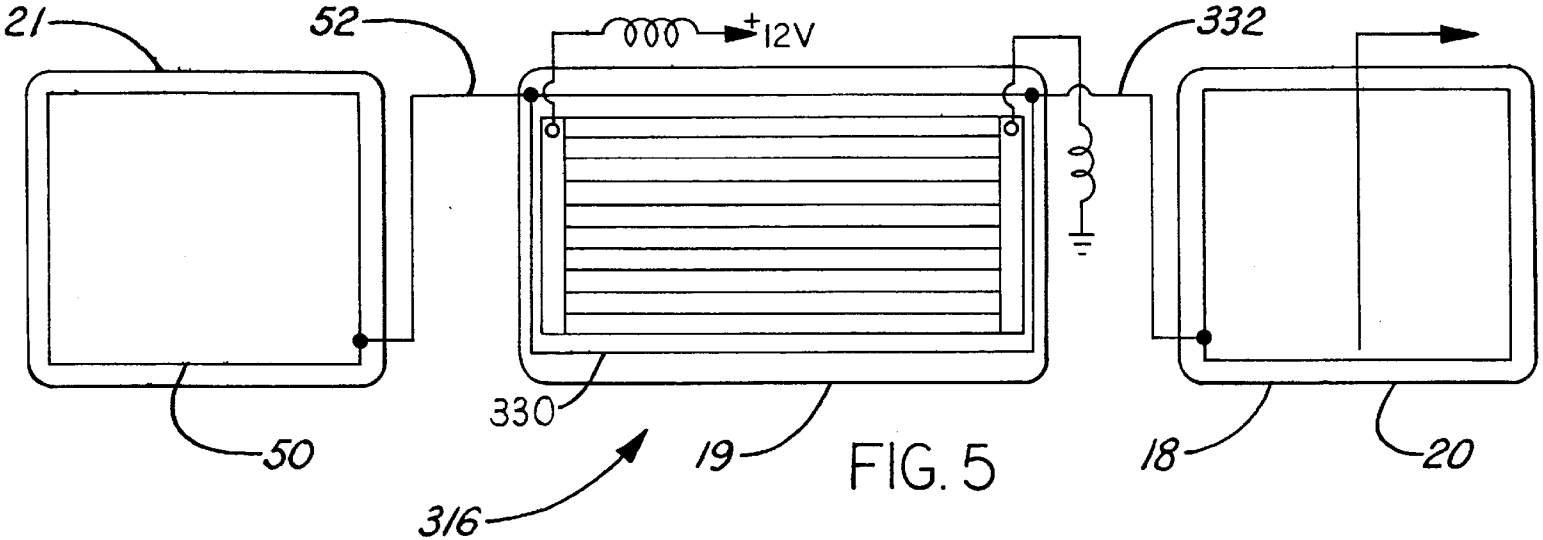
FIG. 5 is a schematic view similar to FIG. 2, illustrating a fourth embodiment of the present invention.

In a fourth embodiment of the present invention, as illustrated in FIG. 5, both the rear window 19 and the left side rear window 21 are used as antenna elements. In this embodiment, similar elements are similarly designated with the first embodiment, while changed elements are designated with 300 series numbers. The second antenna element 330 is connected in series with the first (still primary) antenna element 18 on the right rear side window 20 by the wire 332. This arrangement is generally the same as in the second embodiment, as discussed above. Further, a third antenna element 50, located on the left side rear window 21 is connected in series to the second antenna element 330 by a second wire 52. By having an additional antenna element connected in series, the aperture of the entire antenna system 316 is further increased, although the cost of the system also increases. This third antenna element 50 is shown as just a loop, but again, it can have additional horizontal or vertical lines. And, as discussed above, the second wire 52 can also be coaxial cable, but this is not necessary, as discussed above.

As a further alternative, the antenna elements can be mounted on isolated sheet metal or composite components and will produce results of the overall system similar to the glass mounted elements as discussed above. For example, a composite trunk lid, lift gate, etc. can be used for mounting an antenna element.

While certain embodiments of the present invention have been described in detail, those familiar with the art to which this invention relates will recognize various alternative designs and embodiments for practicing the invention as defined by the following claims.

I claim:

1. An antenna system for a motor vehicle comprising:

a first and a second panel, with the panels being electrically isolated from the vehicle;

a first antenna element, mounted on the first panel, including a first conductor shaped as a generally vertical line and a second conductor generally shaped as a loop, with a first node connecting the first conductor and the second conductor, and with a second node on the second conductor, spaced from the first node;

a second antenna element, mounted on the second panel, including a third conductor having a third node;

a conductive member extending between the second node on the first antenna element and the third node on the second antenna element such that the first and the second antenna elements are connected in series;

a third electrically isolated panel;

a third antenna element mounted thereon, with the third antenna element including a fourth conductor having a fourth node; and a second conductive member extending between the fourth node and the second antenna element.

2. An antenna system for a motor vehicle comprising:

a first window and a second, rear window adapted to mount on the vehicle, with the second window including a heating conductor grid;

a first antenna element, mounted on the first window, including a first conductor shaped as a generally vertical line and a second conductor generally shaped as a loop, with a first node connecting the first conductor and the second conductor, and with a second node on the second conductor, spaced from the first node;

a second antenna element, mounted on the second window, including a third conductor having a third node, with the second antenna element electrically isolated from the heating conductor grid;

a conductive member extending between the second node on the first antenna element and the third node on the second antenna element such that the first and the second antenna elements are connected in series;

an electrically isolated panel and a third antenna element mounted thereon, with the third antenna element including a fourth conductor having a fourth node; and a second conductive member extending between the fourth node and the second antenna element.

3. A motor vehicle including a device for receiving radio frequency signals mounted therein comprising:

at least two windows;

a first antenna element including a first conductor, extending in a substantially vertical direction on a first one of the windows and sized to receive radio frequencies in an FM band range, and a second conductor extending about the first one of the windows in a loop pattern, with a first node connecting the first conductor and the second conductor, and with a second node on the second conductor, spaced from the first node a distance along the second conductor of about I, where I is generally one quarter of a wavelength at the FM band frequencies;

a second antenna element including a third conductor mounted on a second one of the windows including a third node;

conductive means for connecting the second node of the first antenna element and the third node of the second antenna element so that the first and second antenna elements are connected in series;

the second antenna element forming a heating conductor grid and the conductive means including a capacitor mounted between the second node and the third node, with the heating conductor grid including a grid portion, a power source for the grid portion and a ground, and with a first inductor connected between the power source and the grid portion and a second inductor mounted between the grid portion and the ground;

conductive means adapted for communicating a signal between the first antenna element and the device;

a third window and a third antenna element mounted thereon, with the third antenna element including a fourth conductor having a fourth node; and a second conductive means for connecting between the fourth node and the second antenna element so that the second and third antenna elements are connected in series.

* * * * *